United States Patent [19]

Colledge

[11] 4,007,767

[45] Feb. 15, 1977

[54] HIGHSPEED ROTARY BRANDING PROCESS HAVING INCREASED DIE LIFE

[75] Inventor: Gary C. Colledge, Compton, Calif.

[73] Assignee: Colledgewood, Ltd., Compton, Calif.

[22] Filed: July 24, 1975

[21] Appl. No.: 598,772

Related U.S. Application Data

[60] Continuation-in-part of Ser. No. 440,481, Feb. 7, 1974, abandoned, which is a continuation-in-part of Ser. No. 332,298, Jan. 14, 1973, Pat. No. 3,791,290, which is a division of Ser. No. 216,061, Jan. 7, 1972, Pat. No. 3,730,081.

[52] U.S. Cl. ..... 144/328; 101/25; 101/31; 144/2 R; 144/309 F

[51] Int. Cl.[2] ..... B44B 5/02; B27M 1/06

[58] Field of Search ..... 144/309 R, 309 F, 2 D, 144/328, 2 R; 101/5, 8, 22, 25, 31, 32; 219/10.43, 10.49, 10.53, 10.75; 425/385

[56] References Cited

UNITED STATES PATENTS

| | | | |
|---|---|---|---|
| 2,202,110 | 5/1940 | Maurer | 101/25 X |
| 3,294,014 | 12/1966 | Kneisel | 101/25 X |
| 3,764,767 | 10/1973 | Randolph | 144/328 X |

*Primary Examiner*—Leonidas Vlachos
*Assistant Examiner*—W. D. Bray
*Attorney, Agent, or Firm*—Warren, Chickering & Grunewald

[57] ABSTRACT

A process for highspeed branding of an intricate pattern, usually a wood grain pattern, into materials such as particle board, hard board or various lumbers having poor grain characteristics is disclosed. The material to be branded is passed under a heated rotary die having the desired pattern thereon to emboss by heat shrinking and to char the pattern into the material; and the improvement of the process of the present invention, which effects an increased die life, is comprised of maintaining the die at about a temperature between about 800° and about 900° F. This temperature range is high enough to achieve high quality branding and high quantity production, while minimizing degradation of the die pattern from oxidation and contact with the material being branded. The die pattern is preferably relatively deep, in excess of 0.040 inch, and is urged into the material to a depth of about one-half the pattern depth.

6 Claims, 3 Drawing Figures

HIGHSPEED ROTARY BRANDING PROCESS HAVING INCREASED DIE LIFE

RELATED APPLICATIONS

This application is a continuation-in-part application of my co-pending application Ser. No. 440,481, filed Feb. 7, 1974, and entitled HIGH TEMPERATURE, LOW PRESSURE AND HIGHSPEED WOOD GRAIN EMBOSSING PROCESS, now abandoned which application was a continuation-in-part application of co-pending application Ser. No. 332,298, filed Jan. 14, 1973, entitled HIGHSPEED, HIGH TEMPERATURE EMBOSSING MACHINE AND WHEEL THEREFOR, now U.S. Pat. No. 3,791,290 issued Feb. 12, 1974. The last named application was a divisional application of my application Ser. No. 216,061, filed Jan. 7, 1972, now U.S. Pat. No. 3,730,081, issued May 1, 1973, and entitled ROTARY HOT DIE EMBOSSER WITH TAPERED SHAFT AND INSULATED EMBOSSING WHEEL.

BACKGROUND OF THE INVENTION

Prior Art

In U.S. Pat. No. 2,791,290, a highspeed embossing apparatus is disclosed which is particularly well-suited for use in the embossing of relatively deep decorative patterns in molding for furniture, picture frames and the like. This apparatus employs a very hot die (1,000° to 1,200° F. or more) under a substantial pressure to emboss patterns which may have a depth of ¼ inch or greater into lumber that is usually relatively soft at high speeds (for example, 200 feet per minute). Most prior art devices set forth in the application and cited by the Patent Office typically ran at a temperature of about ½ and a speed of about 1/5 of that set forth in U.S. Pat. No. 3,791,290. The apparatus and method set forth in said application employed the very substantially increased die temperatures to achieve a dramatic improvement in production rates and a corresponding reduction in production costs.

In addition to embossing molding, it has long been desirable to be able to emboss a wood grain pattern on articles and particularly sheets or panels. The desirability of embossing such a pattern has increased in recent years since the supply of woods having desirable grain properties has dwindled substantially. The supply of many types of wood which have little or no grain pattern is relatively plentiful, but the use of such wood in furniture, decorative panels, cabinetry, etc., has been limited to situations in which the article would be finished by painting, a plastic laminate, etc.

In order to attempt to utilize woods having poor grain quality, a number of different approaches have been employed. The most widespread process presently in use is a printing process in which ink is imprinted onto the article in a wood grain pattern. In this process, the finish of the panel is controlled by the grain printer, and the manufacturer of the article must attempt to match other wood to the finish of the printed wood.

U.S. Pat. No. 3,294,041 discloses a process in which a die having a pattern of protrusions of substantial height simulating wormholes is heated to a high temperature and urged against the wood product at a very high pressure. A similar process is shown in U.S. pat. No. 3,393,294 in which wormholes are formed by contacting the wood over a substantial period of time by using an endless-tract mounting of the heated protruding elements.

In addition, cold dies have been employed with very substantial pressures to attempt to crush or impress a wood grain pattern into a wooden article. This approach results in chipping and fracturing of the wood fiber, poor grain definition, slow speed and an inability of the impressed grain to visually stand out from the remainder of the wood with a corresponding need to use inks or color fillers to bring out the grain.

U.S. Pat. Nos. 2,703,463 and 3,695,857 disclose low temperature, low speed processes which depend upon high pressure and even support of the panels to effect embossing. A high temperature, high, highspeed embossing apparatus and method similar to that disclosed in my U.S. Pat. No. 3,730,081 is shown in U.S. Pat. No. 3,764,767. In this apparatus and method very high die temperatures on the order of about 1,000° F. are achieved by induction heating and enable embossing of molding at a rate of 200 feet per minute. As was the case with my embossing apparatus, the device of U.S. Pat. No. 3,764,767 is entirely adequate for embossing relatively soft lumbers with a pattern that is relatively gross or coarse in nature.

In my application Ser. No. 440,481, I set forth a process for embossing, or more accurately branding, a wood grain pattern into sheets of material at high, economically feasible production rates. In this process an extremely high temperature die, on the order of about 1,000° F. having an intricate and detailed wood grain pattern thereon, was impressed at relatively low temperature and high speed against panels of lumber to brand a pattern having high definition into the panels. Thus, extremely high die temperatures and relatively low die pressure were employed to achieve a high production output.

While the process of application Ser. No. 440,481, now abandoned, initially met with considerable success, two serious limitations were encountered. It was found that not only is it desirable to be able to brand lumber having poor grain characteristics, but it is also highly desirable to be able to brand particle board and hard board, both of which have no grain characteristics and exhibit extreme surface hardness as compared to most commonly available lumbers. Secondly, it was found that when an intricate and delicate die pattern was employed and heated to extremely high temperatures (1,000° to 1,200° F.), oxidation and wear on the pattern caused rapid degradation of the same with attendant loss of definition in the pattern branded into the lumber. Thus, the operation of dies having delicate patterns at extremely high temperatures was found to cause the die patterns to have an unacceptably short life. This problem was increased when attempting to brand particle board or hard board, which presents an extremely hard surface. Oxidation and wear on the dies under the extremely high temperatures soon caused a degradation of the delicate patterns to a level prohibiting their further use. The cost of etching a steel die 18 inches in diameter and 4 feet in length with an intricate wood grain pattern is substantial ($4000–$5000) and requires that the die be able to be used to brand a very substantial number of panels before it must be replaced.

It is believed that the oxidation and wear phenomena on the die at extremely high temperatures was not observed before in connection with Applicant's method and apparatus as set forth in U.S. Pat. No.

3,730,081 because the patterns employed for embossing molding are inherently rather coarse or gross in nature. Accordingly, there are not normally thin cross-section die protrusions, and oxidation of several thousandths of an inch does not have any appreciable effect on the pattern which is embossed into the molding. Since most moldings are made with soft lumbers, the wear factor was also less than when attempting to brand particle board or hard board. When a die is formed with an intricate wood grain pattern, however, oxidation or wear of a few thousandths of an inch will completely eliminate many of the pattern protrusions creating discontinuities or bald spots in the pattern which are unacceptable. Additionally, carbon build-up on the dies can fill the interstices between protrusions and similarly degrade the die pattern.

Accordingly, it is an object of the present invention to provide a wood grain branding process which can be operated at very high speeds to brand hard board, particle board or lumber with intricate wood grain patterns without causing rapid degradation and deterioration of the die pattern.

Another object of the present invention is to provide a wood grain branding process which can be used for high speed production and has an improved life for its components and particularly the branding die.

It is a further object of the present invention to provide a wood grain branding process which will produce an article having a wood grain branded therein which can be sanded and otherwise finished after branding without destroying the branded pattern.

It is still a further object of the present invention to provide a wood grain branding process which is suitable for branding plywood, particle board and hard board sheets of material.

Another object of the present invention is to provide a wood grain branding process in which the branded grain pattern is discolored during the branding process to simulate the darkened areas of normal wood grain.

Another object of the present invention is to provide a wood grain branding process which is easy to operate, has improved economy, and achieves greater pattern clarity and definition.

Other objects and features of advantage of the wood grain branding process of the present invention will become apparent from or are set forth in detail in the accompanying drawing and the following description of the preferred embodiment.

SUMMARY OF THE INVENTION

The high speed rotary branding process of the present invention includes the step of branding said material by passing the same under a heated rotary die having the pattern thereon at a speed effecting embossing or heat shrinking and discoloration of the material impressed with the pattern, with the improvement comprising the step of maintaining the temperature of the die in the range of about 800° to about 900° F. during the branding step. Maintaining the die in the said range enables a high rate of branding and yet minimizes die oxidation and wear. Maintaining the die at a temperature below 800° F. undesirably reduces the production rate achievable, and temperatures above 900° F. cause a substantial decrease in die life. The preferred operating temperature for a low carbon steel die is 850° F. The die pattern is further preferably selected to have a depth of the pattern defining protrusions of at least about 0.040 inch, and during the branding step the die is urged into the material to a depth of about ½ of the depth of the pattern protrusions.

DESCRIPTION OF THE PREFERRED EMBODIMENT

Figure 1:
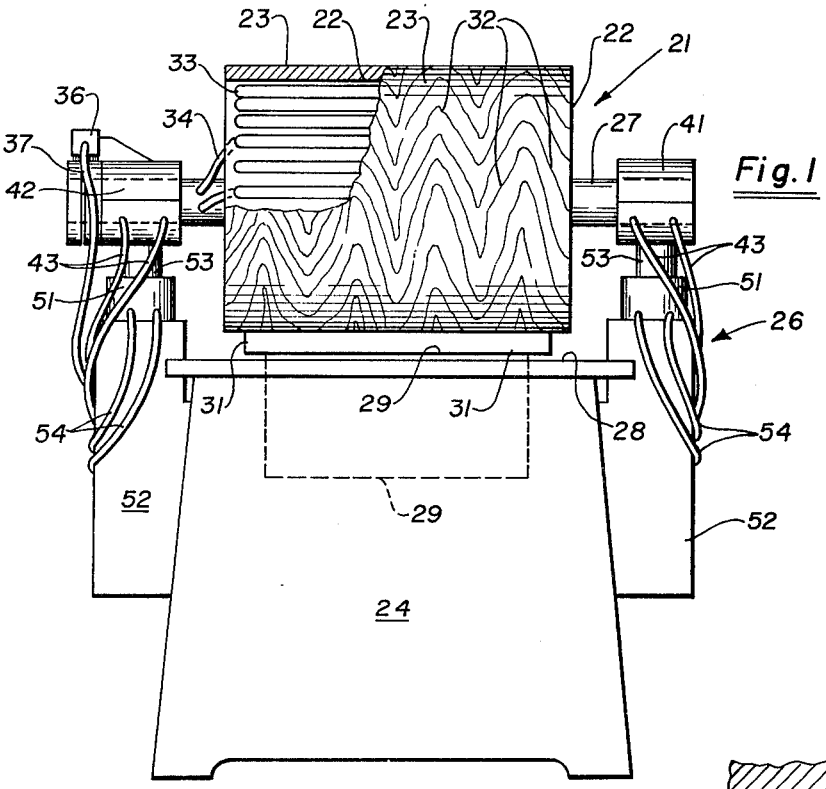
FIG. 1 is a front elevational view, partially broken away, of a rotary branding machine suitable for use in practicing the process of the present invention.
Figure 2:
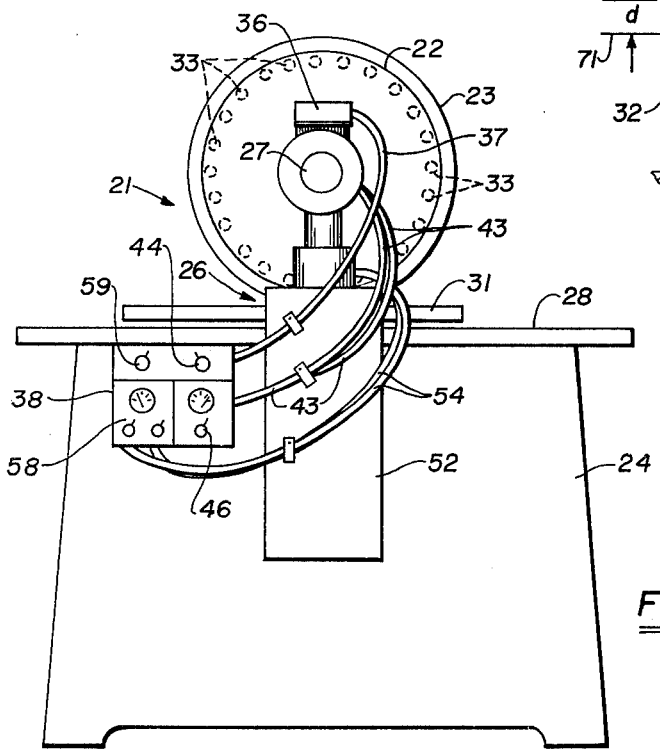
FIG. 2 is a side elevational view of the machine in FIG. 1.

Apparatus suitable for practicing the method of the present invention may be seen in FIGS. 1 and 2. An embossing or branding machine, generally designated 21, having a rotary drum-like element 22 on which a branding or embossing die 23 is removably mounted. Mounted to base 24 is a drum support assembly, generally designated 26, to which drum shaft 27 is rotatably mounted.

In order to accommodate the branding or embossing of materials of various thicknesses and in order to enable an adjustment of the branding pressure, support assembly 26 is preferably formed for selective vertical adjustment of the height of die 23 above work supporting table 28 and work engaging and advancing drum 29. Drum 29 can be used to advance the article or work piece 31 under die 23 and is operatively connected to a motor (not shown) which is usually mounted in base 24. The work advancing drum may be the sole source of power for advancement of member 31 beneath the die, or shaft 27 can be driven, either instead of drum 29, or in synchronism with drum 29. Die 23 is formed with a grain defining pattern 32, and a plurality of resistance heating elements 33 are preferably carried by drum 22 in thermal and electrically insulated cavities in the drum immediately subjacent to die 23. Resistance heating elements 33 are electrically connected by conductors 34 to brush assembly 36, which is in turn connected to conductor 37 to control panel 38. The positioning of resistance heating elements 33 subjacent to die 23 enables the die to be maintained at a uniform and relatively high temperature.

In order to prevent the transfer of heat along the shaft 27 to bearings 41 and 42, the bearings are formed for flow of coolant fluid therethrough and connected by means of fluid conduits 43 to fluid pumping means and a fluid reservoir (not shown). Rheostat 44 on the control panel is used to control the temperature of die 23 while knob 46 controls the coolant flow through bearings 41 and 42.

The contact pressure between the rolling of rotary die 23 and article 31 being branded is varied by means of drum supporting means 26. This can advantageously be accomplished by mounting hydraulic cylinders 51 to support arms 52 secured to base 24 of the embossing machine. Extending upwardly from cylinders 51 and reciprocally mounted therein are a pair of pistons 53, which are secured by their upper ends, by welding or the like, to water cooled bearings 41 and 42. Hydraulic conduits 54 are connected to cylinders 51 and control panel 38 for control of the shaft height above table 28 and the contact pressure between the die and the article being branded. Adjustment of the same is effected by hydraulic controls of 58.

Finally, the rate of advancement of the material beneath the rotary die is controlled by knob 59, which controls the driving drum 29 and/or embossing drum 22.

Having described rotary branding apparatus suitable for use in the process of the present invention, the improved process of the present invention which enables a substantial increase in the life of the branding die without losing the advantages of high speed production may be set forth in detail. Contrary to Applicant's initial efforts which indicated that higher temperatures enabled higher speeds and higher production, Applicant has discovered that for rotary branding of patterns having intricate or delicate designs thereon, there is an optimum temperature range in which high production can be maintained without accelerated deterioration of the branding die.

Initially, it should be noted that the preferred manner of forming a branding or embossing die is to acid etch a low carbon steel plate or cylinder. The die material is preferably formed from 4135 Modified or 4140 Carbon Steel. These carbon steel alloys contain chromium and nickel, which it is believed enhance high temperature performance by slowing oxidation. First, the die material has an acid resist material deposited thereon, such as Kodak photoresist, and the acid resist material is then removed in all areas except the areas in which die protrusions are to occur. The die blank is then placed in an acid bath to form the die pattern. Many of the resulting grain defining protrusions in a wood grain pattern have a cross-sectional thickness in the range of 0.005 to 0.010 inches.

With a die formed as above described, it has been discovered that the life of the die can be greatly extended by operating the branding process at a die temperature in the range of about 800° to about 900° F. Operating such a die at a temperature of 1100° F., for example, allows branding of various types of plywood to proceed at a very high production rate. For 4-foot by 8-foot plywood panels of poor grain Luan mahogany, a production rate of 900 panels per hour can be achieved at die temperatures of 1100° F. The pattern definition branded into the panels, however, reaches unacceptable levels after a total of only 50,000 panels (7 shifts of 8 hours duration).

The same panels when branded at 850° F. can be branded at a rate of 600 panels per hour, but the dies will produce high pattern definition in the branded product for more than 300,000 panels with no visible wear. Below about 800° F. the production rate drops to 300 panels per hour. Additionally, below 800° F. more pressure is required which is particularly undesirable when branding hard board or particle board, which require more pressure than lumber as a result of their high surface hardness. As the temperature drops below 800° F., there is also some tendency to fracture fibers (particularly when the branding speed exceeds 30 feet per minute) rather than heat shrink and burn away fibers in a branding process.

Since increased pressure can also accelerate die wear, a drop off in the life of the die is also observed when hard surfaced materials such as particle board are embossed at temperatures below 800° F. Thus, 4 × 8 foot particle board panels embossed with a die at 700° F. must be run at about a speed of 200 to 250 panels per hour, and the die is not hot enough to char the impressions left in the panel. By contrast, when operated at 850° to 875° F. panels of particle board can be branded at a rate of 450 panels per hour with the pattern impressions being charred or discolored. No significant die oxidation or wear occurs under these conditions.

When hard board panels are run at 1100° F., a production rate of 360 panels per hour can be achieved, but the die has a life of only 20,000 panels. By contrast, at 900° F. hard board panels can be branded at 200 per hour with no significant wear.

It should be noted that lowering the temperature and branding of hard surface materials does require substantially higher die contact pressures than set forth in my application Ser. No. 440,481, now abandoned.

The possibility of attempting to use dies formed from less corrosive or higher strength materials has been considered. Stainless steel dies might be operable at higher temperatures without excessive oxidation or wear. Stainless steel, however, is extremely difficult to etch with a fine or intricate pattern. The cost of the etching process for an 18 inch diameter drum four feet in length using currently known technology increases from $4000 to $5000 for 4135 modified carbon steel to $25,000 for stainless steel. Whether such a stainless steel die would be satisfactory for high production runs in only speculative, and the cost is, in any event, prohibitive.

Typically, wood panels which are to be branded with a grain pattern are manufactured to a thickness tolerance of about 0.010 inches. Thus, over the width or length of the board a variation in thickness of 10 mils may be experienced. In order to insure branding of the complete grain pattern and further to reduce the incidence of charring intermediate of the pattern defining protrusions, it has been found preferable to form the die with a pattern depth of at least about 0.040 inches.

Figure 3:
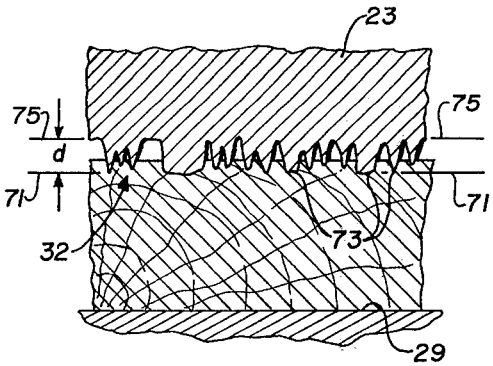
FIG. 3 is a greatly enlarged, fragmentary view, in cross-section of the branding die and a sheet of material being branded.

As may be seen in FIG. 3, the nominal outside diameter 71 of the die protrusions 73 is etched to a depth *d* of at least 0.040 inches from the nominal inside diameter 75 of the die. It is further preferable that the depth *d* be about 0.060 inches. During the branding step die 23 is preferably urged to a depth of about one-half of the depth of the pattern defining protrusions in the die. For a die having a depth *d* of about 0.060 inches, the die will be set to have an interference or depth of penetration of about 0.025 inches. Since the panel may vary plus or minus 5 mils, the depth of penetration may range between about 0.020 to about 0.030 inches. This depth of penetration insures branding of the protrusion pattern into the panel without charring the wood intermediate the pattern.

The process of the present invention provides not only a grain pattern impression in the material, but also simultaneously brands, discolors or chars the pattern in a manner closely simulating the color of wood grain. This coloring is effected without the use of inks or flooding of cold impressions with paint and reversing the excess paint of the areas intermediate the grain pattern. Thus, high speed grain pattern branding of panels can be accomplished in a single process without undue wear and without special support for the panels.

What is claimed is:

1. In a process of highspeed rotary branding of pattern into a material such as hardboard, particle board, lumber or the like including the step of branding said material by passing the same under a heated rotary die at a speed effecting discoloration of the material impressed with said die, the improvement comprising the steps of:

selecting a rotary die having a pattern thereon comprised of a plurality of intricate protrusions dimensioned to brand a pattern having fine details into said material; and maintaining the temperature of said die in the range of about 800° F. to about 900° F. during said branding step.

2. A process for branding a pattern as defined in claim 1 wherein, said selecting step is accomplished by selecting a die formed with a wood grain pattern thereon.

3. A process for branding a pattern as defined in claim 1 wherein, the temperature of said pattern on said die is maintained in the range of about 825° to about 875° F.

4. A process for branding a pattern as defined in claim 1, and the step of:

selecting a rotary die formed of low carbon steel, and said die is maintained at a temperature of about 850° to about 875° F.

5. A process for branding a pattern as defined in claim 3 wherein, said rotary die is formed of 4135 modified carbon steel.

6. A process for branding a pattern as defined in claim 3 wherein, said rotary die is formed of 4140 carbon steel.

* * * * *

UNITED STATES PATENT AND TRADEMARK OFFICE

CERTIFICATE OF CORRECTION

PATENT NO. : 4,007,767

DATED : February 15, 1977

INVENTOR(S) : Gary C. Colledge

It is certified that error appears in the above-identified patent and that said Letters Patent are hereby corrected as shown below:

Column 1, line 26, the patent number should be indicated as ---3,791,290---.

Column 2, line 11, the second patent number should be indicated as ---2,695,857---.

Column 6, line 25, change the first "in" to ---is---;

line 57, change "of" to ---off---;

line 60, after "undue", insert ---die---, which was deleted;

line 62, after "process", change "of" to ---for---.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*